US007874964B2

(12) United States Patent
Reynolds

(10) Patent No.: US 7,874,964 B2
(45) Date of Patent: Jan. 25, 2011

(54) SYSTEMS FOR DETERMINING THE POSITION OF A PUNCHING BAG

(75) Inventor: John Matthew Reynolds, 501 Pamela La., Kirkwood, MO (US) 63122

(73) Assignee: John Matthew Reynolds, Kirkwood, MO (US)

( * ) Notice: Subject to any disclaimer, the term of this patent is extended or adjusted under 35 U.S.C. 154(b) by 83 days.

(21) Appl. No.: 12/349,099

(22) Filed: Jan. 6, 2009

(65) Prior Publication Data

US 2009/0176620 A1 Jul. 9, 2009

Related U.S. Application Data

(60) Provisional application No. 61/010,104, filed on Jan. 7, 2008.

(51) Int. Cl.
*A63B 69/32* (2006.01)
*A63B 69/34* (2006.01)
*A63B 15/02* (2006.01)

(52) U.S. Cl. ..... 482/84; 482/1; 482/83

(58) Field of Classification Search ..... 482/1, 482/8, 83–84, 86–87, 89, 901; 273/440; 463/1; 434/247

See application file for complete search history.

(56) References Cited

U.S. PATENT DOCUMENTS

| | | | | |
|---|---|---|---|---|
| 2,249,309 | A | 7/1941 | Benko | |
| 4,027,875 | A | 6/1977 | Hurley | |
| 4,199,987 | A | 4/1980 | Bauers et al. | |
| 4,209,168 | A * | 6/1980 | Partlow | 482/87 |
| 4,527,796 | A | 7/1985 | Critelli | |
| 4,534,557 | A | 8/1985 | Bigelow et al. | |
| 4,634,116 | A | 1/1987 | Amador et al. | |
| 4,721,302 | A | 1/1988 | Murphy | |
| 4,883,271 | A | 11/1989 | French | |
| 4,941,660 | A | 7/1990 | Winn et al. | |
| 5,437,590 | A | 8/1995 | D'Alto | |
| 5,553,860 | A * | 9/1996 | Zelikovich | 473/455 |
| 5,605,336 | A | 2/1997 | Gaoiran et al. | |
| 5,607,377 | A | 3/1997 | Wilkinson | |

(Continued)

FOREIGN PATENT DOCUMENTS

DE 10323348 A1 2/2004

(Continued)

*Primary Examiner*—Loan Thanh
*Assistant Examiner*—Sundhara M Ganesan
(74) *Attorney, Agent, or Firm*—Armstrong Teasdale LLP

(57) ABSTRACT

A punching bag system is provided for determining the position of a punching bag. A punching bag is suspended by a coupling from a stand which permits the punching bag to travel between an up position where it is in contact with a contact area on the stand, and a down position where it is free from contact with the stand. Light-emitting devices and light-receiving devices are radially positioned on the stand between the coupling and the contact area. Light is emitted from the light-emitting devices and reflected into the light-receiving devices when the punching bag is in the up position. The light-receiving devices generate an output proportional to the amount of light received therein which is analyzed to determine if the punching bag is in the up position. A metric is determined based in part on the determined position and is presented by an output device.

27 Claims, 9 Drawing Sheets

U.S. PATENT DOCUMENTS

| | | | | |
|---|---|---|---|---|
| 5,733,193 | A | 3/1998 | Allard et al. | |
| 5,803,877 | A | 9/1998 | Franey | |
| 5,921,896 | A | 7/1999 | Boland | |
| 5,941,801 | A | 8/1999 | D'Alto | |
| 6,464,622 | B1 | 10/2002 | Clark | |
| 6,921,332 | B2 * | 7/2005 | Fukunaga et al. | 463/8 |
| 7,014,526 | B1 | 3/2006 | Chamberlin | |
| 7,128,692 | B2 | 10/2006 | Black | |
| 7,513,852 | B2 * | 4/2009 | Wilkins et al. | 482/8 |
| 2002/0022518 | A1 * | 2/2002 | Okuda et al. | 463/36 |
| 2002/0065121 | A1 * | 5/2002 | Fukunaga et al. | 463/8 |
| 2002/0098946 | A1 * | 7/2002 | Clark | 482/1 |
| 2003/0216228 | A1 * | 11/2003 | Rast | 482/84 |
| 2005/0266967 | A1 * | 12/2005 | Considine et al. | 482/84 |
| 2006/0066056 | A1 | 3/2006 | Wiblin | |
| 2006/0252608 | A1 * | 11/2006 | Kang et al. | 482/84 |
| 2007/0161459 | A1 | 7/2007 | Watson | |
| 2008/0015058 | A1 | 1/2008 | Noble et al. | |
| 2008/0174548 | A1 | 7/2008 | Jones et al. | |

FOREIGN PATENT DOCUMENTS

| | | | |
|---|---|---|---|
| FR | 2757410 | A1 | 6/1998 |
| GB | 2220749 | A | 1/1990 |
| GB | 2328605 | A | 3/1999 |
| GB | 2355803 | A | 5/2001 |
| GB | 2439381 | A | 12/2007 |
| WO | 9910052 | A1 | 3/1999 |
| WO | 02066120 | A1 | 8/2002 |
| WO | 2004070336 | A1 | 8/2004 |
| WO | 2006075933 | A2 | 7/2006 |

* cited by examiner

SYSTEMS FOR DETERMINING THE POSITION OF A PUNCHING BAG

CROSS REFERENCE TO RELATED APPLICATIONS

This application claims priority from U.S. Provisional Application No. 61/010,104 entitled "Speed Bag Display", filed Jan. 7, 2008. The disclosure of said application is incorporated by reference in its entirety.

BACKGROUND OF THE INVENTION

This invention generally relates to athletic training equipment and, more specifically to determining the position of a punching bag.

A punching bag (i.e., an athletic training device) is designed to be repeatedly struck by an individual. A speed bag is a small punching bag which comprises a generally round body that decreases in diameter towards an upper end, thereby forming a neck that is of significantly smaller diameter that the generally round body. The neck is attached at a terminal end to a stand by a swivel connector or other coupling. The coupling permits the speed bag to freely pivot about its terminal end. The stand is vertically positioned such that the portion of the generally round body of the speed bag having the largest diameter is positioned at or around the eye-level of an individual utilizing the speed bag. The coupling is attached to a section of the stand which comprises a circular or rectangular platform that is generally planar and rigid. The stand is in turn attached to a fixed structure, such as a wall or ceiling. Alternatively, the stand may be free-standing.

In operation, an individual strikes the generally round body of the speed bag with a portion of their body (i.e., their hand). The bag accordingly travels away from the individual and strikes the generally planar and rigid section of the stand. The speed bag rebounds off of the stand and travels toward the individual. The process then repeats itself, with the individual striking the bag again. A variety of techniques or rhythms may be utilized by an individual when striking the bag. For example, according to one technique (i.e., a triplet rhythm) an individual may strike the bag after it has rebounded off the stand three times.

As the speed bag is an athletic training device, individuals utilize it to improve their coordination or level of conditioning. Accordingly, individuals often desire to measure the rate at which they are striking the speed bag to gauge their progress in improving their level of coordination or to compare their rate of striking the bag to the rates achieved by other individuals. While an individual may be able to comparatively differentiate the rate at which they are able to strike the bag, they are generally not able to quantitatively measure the rate at which they strike the bag.

Previous systems measure the rate at which the individual strikes the speed bag with mechanical pressure sensors that record each instance of the speed bag coming into contact with the stand. Mechanical sensors are positioned such that the speed bag contacts the sensors when rebounding off of the stand. These sensors inevitably degrade and fail over time as they are subjected to repeated mechanical contact with the speed bag. Other systems measure the rate of striking the bag with optical sensors that require the bag to interrupt a beam of light emitted from one sensor and received by another sensor. Each "interruption" or interval thereof is recorded as a strike upon the speed bag. To function properly, the sensors must be positioned such that they are prone to being struck by the speed bag during normal operation and therefore suffer similar shortcomings common to systems utilizing mechanical pressure sensors.

Accordingly, a system and corresponding methods are needed which reliably determine the position of a speed bag without subjecting the system to mechanical contact with the speed bag.

BRIEF DESCRIPTION OF THE INVENTION

A first aspect is a punching bag system comprising a punching bag, a stand, a coupling, light-emitting devices, limit-receiving devices, and a controller. The punching bag has first and second ends and a longitudinal axis. The stand has a bottom face including a ring-shaped contact area. The coupling is attached to the bottom face and to a second end of the punching bag, wherein the coupling permits the punching bag to travel between an up position in which a portion of the punching bag is disposed near or in contact with the contact area on the bottom face of the stand and a down position where the portion of the punching bag near or on the generally round body is substantially spaced apart from the bottom face of the stand. The light-emitting devices are radially positioned on the bottom face of the stand and are configured to emit light and are radially spaced from the coupling and the contact area. The light-receiving devices are radially positioned on the bottom face of the stand and are configured to generate a signal upon receiving light and are radially spaced from the coupling and the contact area, and wherein light emitted by the light-emitting devices is reflected into the light-receiving devices by the punching bag when the punching bag is in the up position. The controller is configured to measure the signals from the light-receiving devices and determine when the punching bag is in the up position or the down position based on the signal. After determining a cycle of three successive determinations of the punching bag being in the up position and then in the down position, the controller determines that the punching bag has been punched. The controller outputs a metric based at least in part on the number of instances that the punching bag has been punched over a period of time.

Another aspect is a punching bag system comprising a punching bag, a stand, light-emitting devices, light-receiving devices, a controller, and an output device. The punching bag has a diameter that varies about its longitudinal axis. The punching bag comprises a generally round body having a first diameter that is the largest diameter of the punching bag, a neck longitudinally spaced apart from the generally round body and having a second diameter less than the first diameter, a first longitudinal end at an end of the longitudinal axis nearest the generally round body and a second longitudinal end at an end of the longitudinal axis nearest the neck, and the first diameter is longitudinally spaced apart from the second longitudinal end by a first distance. The stand has at least a bottom face, and a coupling is attached to the bottom face and connects at least a portion of the second longitudinal end of the punching bag to the bottom face of the stand. The coupling permits the punching bag to travel between an up position where a portion of the punching bag near or on the generally round body is in contact with the bottom face of the stand a down position where the portion of the punching bag near or on the generally round body is substantially spaced apart from the bottom face of the stand. The light-emitting devices are radially positioned on the bottom face of the stand and are configured to emit light and are radially spaced from the coupling device at a second distance. The second distance is less than the first distance. The light-receiving devices are radially positioned on the bottom face of the stand and configured to generate an output upon receiving light and are radially spaced from the coupling device at the second distance. Light emitted by the light-emitting devices is reflected into the light-receiving devices by the punching bag when the punching bag is in the up position. The controller measures the output from the light-receiving devices and determines when the punching bag is in the up position or the down position based on the output. The controller determines a metric based at least in part on the determination of whether the punching bag is in the up position or the down position. The output device presents the metric.

Another aspect is an apparatus for determining the location of a punching bag and presenting a metric based at least in part on the determined location of the punching bag. The apparatus comprises a circular housing, light-emitting devices, light-receiving devices, a controller, and an output device. The circular housing has an inner diameter and an outer diameter and is configured to be attached to a stand. The inner and outer diameters are sized to permit a punching bag to be suspended from a coupling attached to the stand and positioned inside the inner diameter of the circular housing. The outer diameter of the circular housing is sized to prevent contact between the punching bag and the housing when a portion of the punching bag is in contact with stand while the punching bag is in an up position. The light-emitting devices are radially positioned within the circular housing and configured to emit light. The light-receiving devices are radially positioned within the circular housing and configured to receive light emitted by the light-emitting devices. At least some of the light emitted from the light-emitting devices is reflected into the light receiving devices when the punching bag is in the up position. The controller measures the output from the light-receiving devices and determines whether the punching bag is in the up position or a down position wherein the punching bag is substantially spaced apart from the stand. The controller determines a metric based at least in part on the determination of whether the punching bag is in the up position or the down position. The output device presents the metric.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

DETAILED DESCRIPTION OF THE INVENTION

Figure 1:
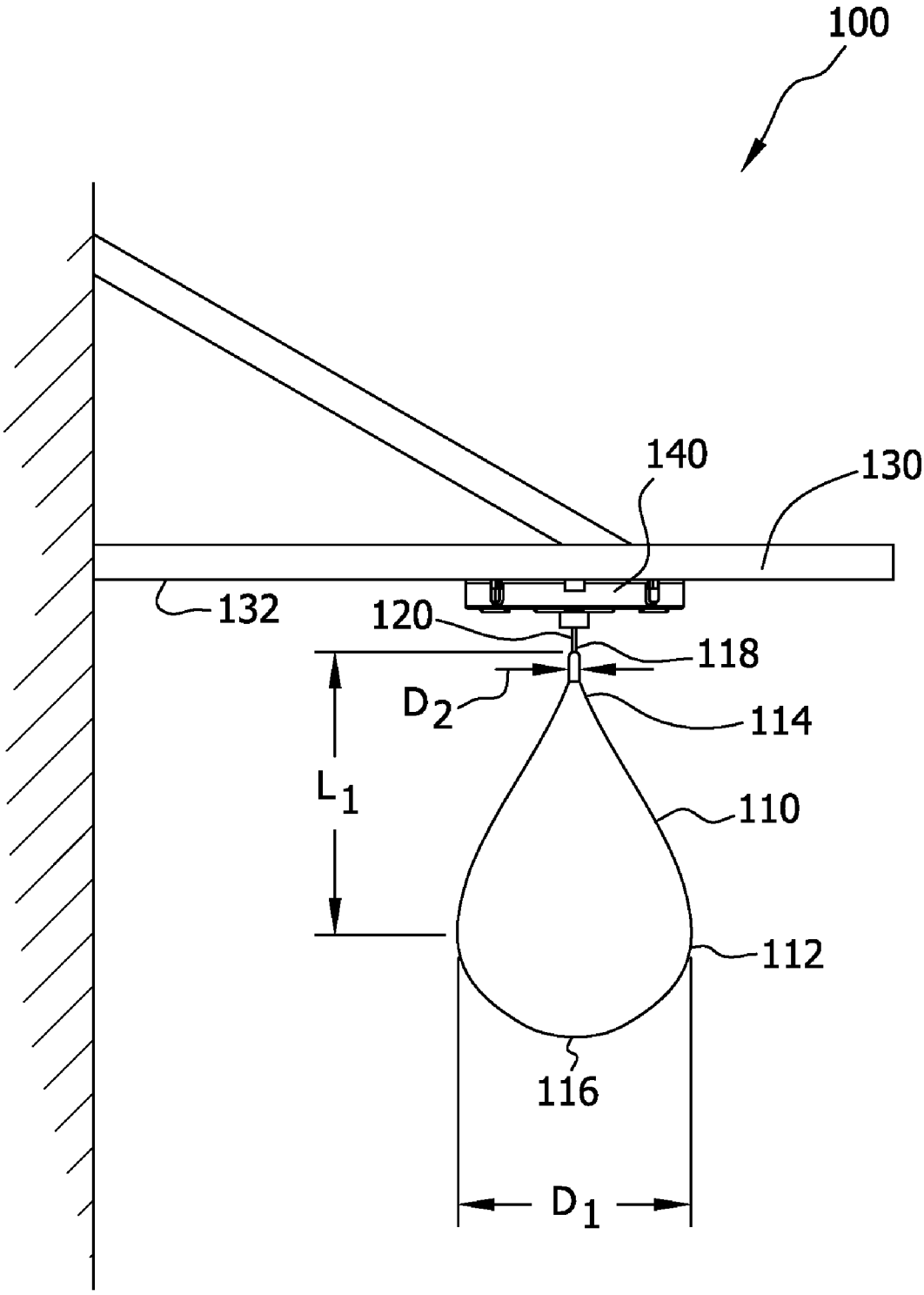
FIG. 1 is a side view of a punching bag in a down position.
Figure 2:
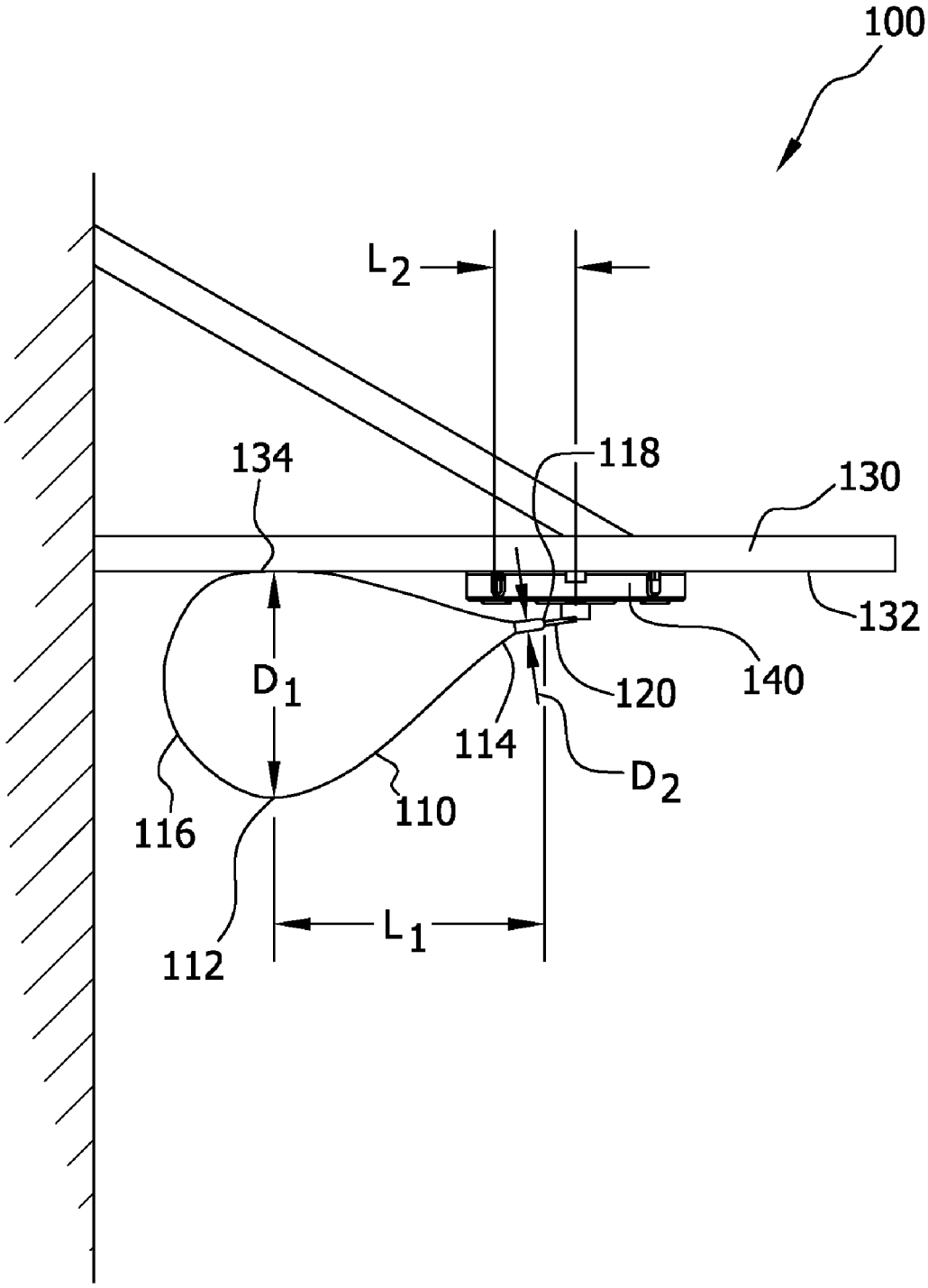
FIG. 2 is a side view of a punching bag in an up position.

A punching bag system 100, as generally shown in FIGS. 1 and 2, comprises a punching bag 110, a connector 120, and a stand 130. The punching bag 110 depicted in the Figures is a speed bag, and is designed to be repetitively punched by a user to improve coordination and increase stamina. As used herein, the terms "punching bag" and "speed bag" are interchangeable.

The punching bag 110 has a diameter that varies about its longitudinal axis. The punching bag is comprised of a generally round body 112 and a neck 114 longitudinally spaced apart from the generally round body. The generally round body 112 has a first diameter D1 which is the largest diameter of the punching bag 110. The neck 114 has a second diameter D2 which is smaller than the first diameter D1. The punching bag 110 has a first longitudinal end 116 at an end of the longitudinal axis nearest the generally round body 112 and a second longitudinal end 118 at an end of the longitudinal axis nearest the neck. The first diameter D1 is spaced apart from the second longitudinal end 118 by a first distance L1.

Included within the punching bag system 100 of this embodiment is an air bladder (not shown). Air (or any other suitable gas) is enclosed within the air bladder at a pressure above that of the surrounding atmosphere. Thus, the pressurized air bladder provides the speed bag with resilient or elastic properties similar to other air-inflated objects utilized in athletics (e.g., basketballs, volleyballs, and soccer balls.). Accordingly, upon coming into contact with the stand 130 or the body of the user, the punching bag 110 will rebound or bounce therefrom.

Speed bags (i.e., punching bags) are provided in varying sizes for users of different abilities. Generally, larger bags are better suited for novices because they travel slower, and smaller bags are more appropriate for advanced users because they travel faster. Larger bags are approximately 13 to 11 inches in length by 10 to 8 inches in diameter at their largest diameter (i.e., at the generally round body). Smaller bags range in size from approximately 8 to 6.5 inches in length and 5 to 4 inches in diameter. Additionally, bags for users of intermediate skill are available in lengths of 10 to 9 inches and diameters of 7 to 6 inches.

The stand 130 supports the punching bag 110 and is constructed of a rigid material. The stand 130 is either free-standing or attached to a fixed structure (e.g., a wall or ceiling) for support (as depicted in FIGS. 1 and 2). The stand 130 has a bottom face 132 upon which the punching bag 110 comes into contact therewith. The stand 130 may be partially circular in shape, with rounded-off edges. A ring-shaped contact portion 134 of the stand 130 defines an area on the bottom face 132 of the stand where the generally round body 112 of the punching bag 110 comes into contact therewith. According to some embodiments, the stand 130 may be constructed out of a suitably rigid material, such as wood or fiberglass.

The connector 120 is attached to the bottom face 132 of the stand 130 and the second longitudinal end 118 of the punching bag 110. The connector 120 thus couples the punching bag 110 to the stand 130. A variety of different types of connector 120 may be used, according to some embodiments, such as swivels, ball hooks, or chain links. The connector 120 permits the punching bag 110 to freely travel between an up position (as depicted in FIG. 2) and a down position (as depicted in FIG. 1). In the up position, a portion of the speed bag near or on the generally bound body 112 is in contact with the ring-shaped contact portion 134 of the bottom face 132 of the stand 130. The ring-shaped contact portion 134 is located at or near the sum of the first distance L1 and a length of the connector 120. In the down position, the generally round body 112 is substantially spaced apart from the bottom face 132 of the stand 130.

Figure 3:
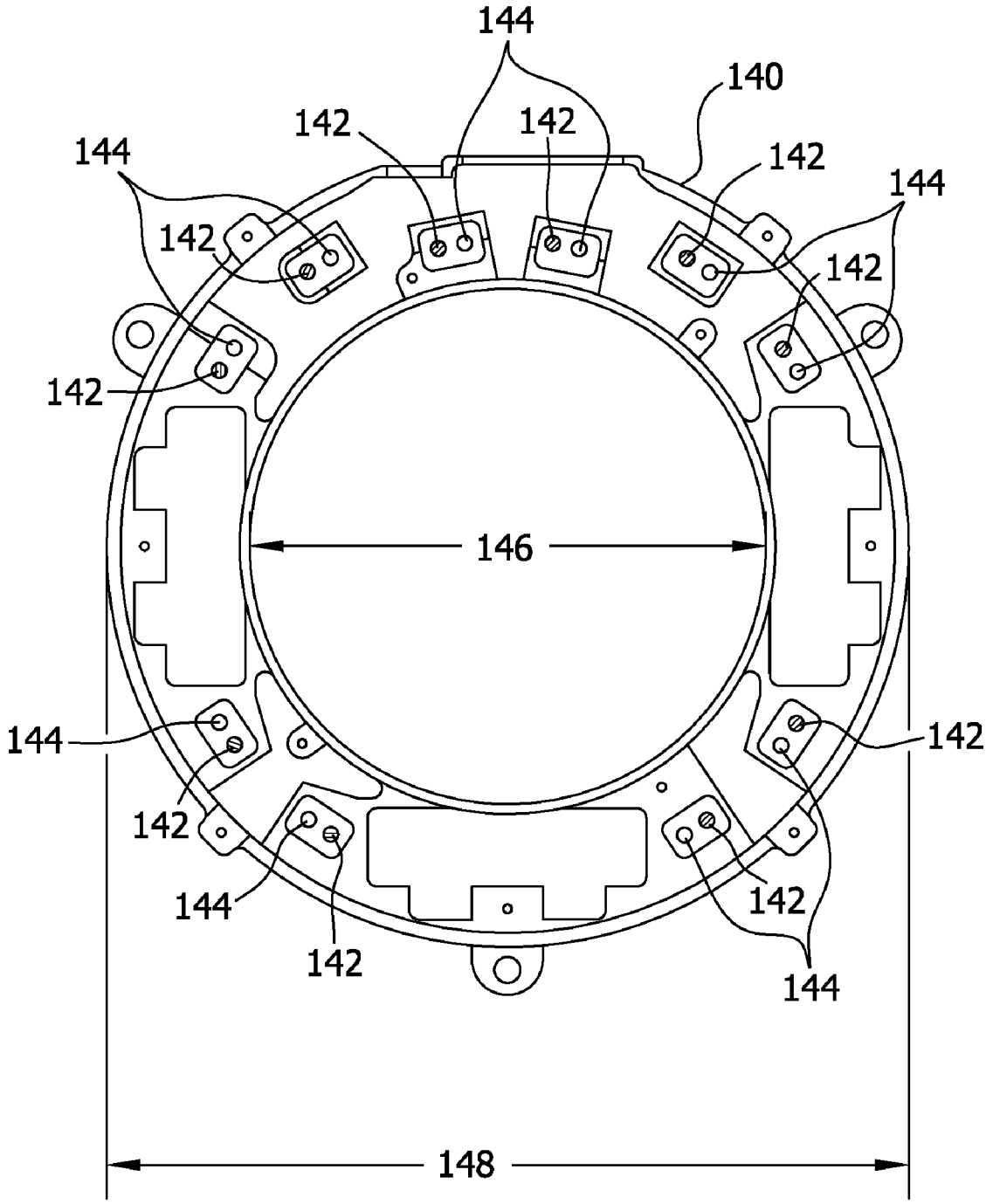
FIG. 3 is a top plan view of a housing.
Figure 4:
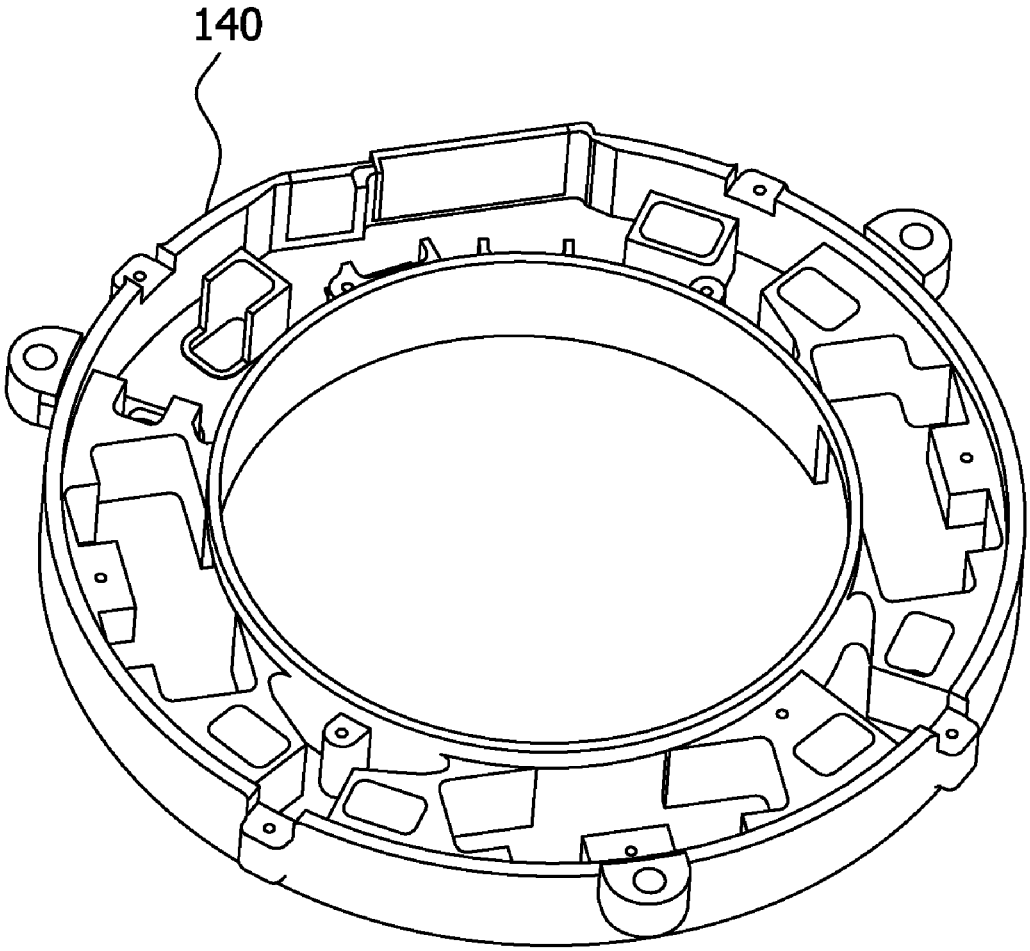
FIG. 4 is a perspective view of the portion of the housing depicted in FIG. 3.
Figure 6:
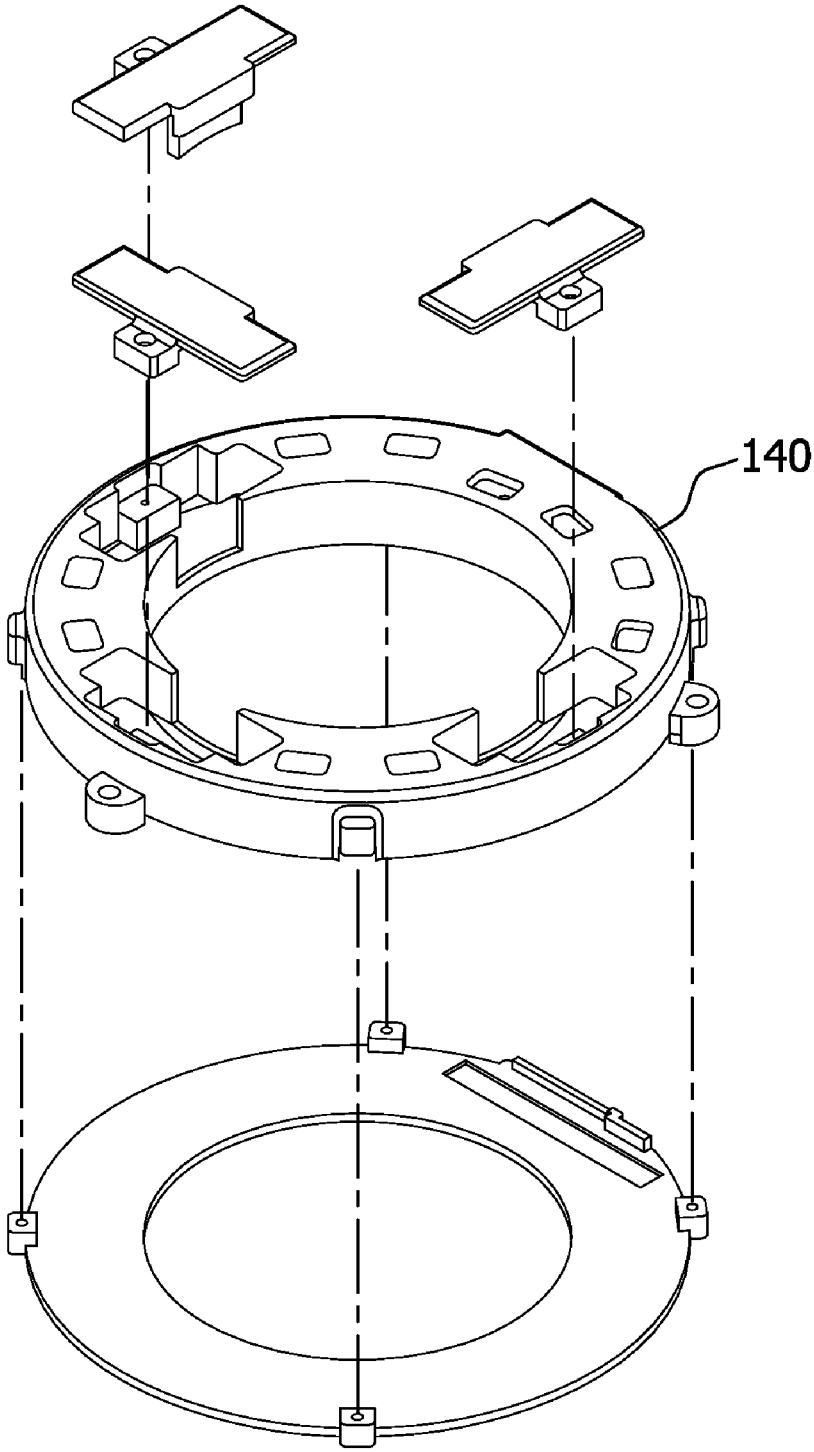
FIG. 6 is an exploded perspective view of the housing.

A housing 140 is attached to the bottom face 132 of the stand 130. Light-emitting devices 142 (as best seen in FIG. 3) are radially positioned in the housing 140 and are configured to emit light. In other embodiments, the light-emitting devices 142 are positioned within the bottom face 132 of the stand 130, and the housing 140 is not utilized. As best seen in FIG. 6, a housing cover 156 is placed atop the housing 140. The housing cover 156 is removable to permit access to an interior portion of the housing 140. The housing 140 and housing cover 156 may be constructed out of a variety of materials, including without limitation plastic.

Regardless of whether they are positioned within the housing 140 or within the bottom face 132, the light-emitting devices 142 are radially spaced from the intersection of the connector 120 and the bottom face 132 at a second distance L2, which is less than the first distance L1. The generally round body 112 of the punching bag 110 thus does not come into contact with the light-emitting devices during operation of the punching bag system 100.

Light-receiving devices 144 are radially positioned in the housing 140 and are configured to receive light. Like the light-emitting devices 142, the light-receiving devices 144 may alternatively be positioned within the bottom face 132 of the stand 130, and the housing 140 is subsequently not utilized. The light-receiving devices 144 are radially spaced from the intersection of the connector 120 and the bottom face 132 at the second distance L2. The generally round body 112 of the punching bag 110 thus does not come into contact with the light-emitting devices during operation of the punching bag system 100.

According to some embodiments, the light-emitting devices 142 may be light-emitting diodes (LEDs) configured to emit infrared light. The light-receiving devices 144 may likewise be configured to receive infrared light, and only generate an output signal when infrared light is received, and not light having other wavelengths (e.g., ultraviolet or visible light). In other embodiments, different types of light may be emitted from the light-emitting devices 142 and the light-receiving devices 144 may thus be configured to receive different types of light. According to some embodiments, the light-receiving devices 144 are optical sensors (e.g., photo diodes, photo transistors, or photo resistors).

The light-receiving devices 144 output a signal which varies in strength based on the amount or intensity of light received therein. For example, the signal may vary between 0 volts and 5 volts based on the amount or intensity of light received. Other embodiments may utilize light-receiving devices 144 which alter the frequency or amplitude of an output signal based on the amount or intensity of light received.

An output of a signal equal to 0 volts is generated by the light-emitting devices 142 when light is not received in the light-receiving device 144. The signal increases in voltage in proportion to the intensity of light received, with a signal of 5 volts being output when the light-receiving device 144 is receiving its maximum rated intensity of light. Accordingly, when the light-receiving device 144 receives light, a signal is output that is proportional to the intensity of the received light. When higher-intensity light is received in the light-receiving device 144, a signal of greater strength (i.e., higher voltage) is output.

In the embodiments depicted in FIGS. 3-6, the light-emitting devices 142 and the light-receiving devices 144 are positioned in pairs of one light-emitting device and one light-receiving device. According to other embodiments, different configurations may be utilized. For example, a single continuous ring-shaped light-emitting device and a similarly shaped light-receiving device may be utilized. Furthermore, while 8 pairs of light-emitting devices 142 and light-receiving devices 144 are depicted in FIG. 3, more or fewer pairs may be utilized. For example, if light-emitting devices 142 which generate more light are utilized, their number may be reduced.

The light-emitting devices 142 and the light-receiving devices 144 are positioned (either in the housing 140 or the stand 130) such that the light-receiving devices do not receive light therein without the light first being reflected off of a surface. For example, a shroud may surround a circumferential portion of the light-receiving devices 144 and thus prevent light from entering therein along the circumferential portion. Further, light is emitted from the light-emitting devices 142 at a shallow angle, thus reducing the likelihood of light entering the light-receiving devices 144 before being reflected off of the punching bag 110. Accordingly, light emitted by the light-emitting devices 142 is thus prevented from directly entering the light-receiving devices 144.

The housing 140 has an inner diameter 146 and an outer diameter 148. As shown in FIGS. 1 and 2, the inner diameter 146 is to permit the punching bag 110 and connector 120 to be displaced therein. The outer diameter 148 of the housing 140 is sized to prevent contact between the punching bag 110 and the housing when the punching bag is in the up position. The outer diameter 148 defines a circumferential portion of the housing 140.

Figure 5:
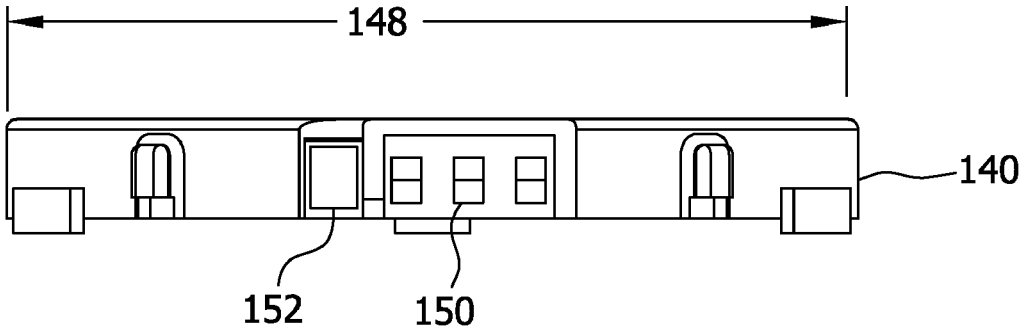
FIG. 5 is a side view of the portion of the housing depicted in FIG. 3.

As shown in FIG. 5, an output device 150 and a switch 152 are incorporated into the housing 140 along the circumferential portion defined at least in part by the outer diameter 148. In other embodiments, the output device 150 and switch 152 are not incorporated in the housing 140, and are instead incorporated into a portion of the stand 130 or another structure (not shown). As the housing is generally positioned at or near eye-level of a user utilizing the punching bag system 100, the output device is also located at or near eye-level of the user. Thus, the user does not need to look away from the direction of the punching bag 110 in order to view the output device 150. While a push button switch is depicted in FIG. 5, additional types of switches are contemplated, such as a plurality of switches or a keypad.

In one embodiment, the output device 150 is a visual display indicator device, such as a liquid crystal display (LCD) or a seven-segment light-emitting diode (LED) display. In other embodiments, the output device 150 may be an audio output device, such as a speaker. In still other embodiments, the output device 150 may be an electronic communication interface configured to output information to a computing system. Examples include wireless (e.g., Bluetooth or 802.11) or wired (e.g., USB) communication systems.

A controller 160 (as best seen in FIG. 3) is provided for measuring the signals output by the light-receiving devices 144 and determining when the punching bag 110 is in the up position or the down position based on the signals. The controller 160 is contained within the housing 140 according to some embodiments, while in other embodiments is separate from the housing. Included within the controller 160 are computing processing components, such as input/output devices, forms of computer readable memory or storage devices, and computer processors. The computer readable memory includes computer-executable instructions thereon. The computer-executable instructions control the operation of the controller 160. The components included within the controller 160 may be packaged in an integrated circuit or on a printed circuit board. The switch 152 is operable by the user to control function of the controller 160, such as turning the controller on or off, or directing the controller to perform various functions.

The controller 160 is coupled to the light-emitting devices 142 and the light-receiving devices 144 by any suitable electrical connection system, such as wires or a printed circuit. The controller 160 supplies the proper amount of electrical current to operate the light-emitting devices 142 and light-receiving devices 144. Electrical current is supplied to the controller 160 by batteries in some embodiments. The batteries are contained in the housing 140 and accessible via removable battery covers 154. In other embodiments, the controller 160 is supplied with electrical current by an electrical outlet or supply source, as are commonly available in consumer applications.

In operation, the controller 160 sends electrical current to the light-emitting devices 142 at a regular frequency, according to some embodiments. Thus light is emitted from the light-emitting devices 142 at regular intervals. By emitting light at periodic intervals, the life of the batteries powering the controller 160 is prolonged and the intensity of the light emitted from the light-emitting devices 142 is able to be increased. Light-emitting devices 142 are often capable of emitting light at an increased intensity when emitting light therefrom at periodic, short intervals compared to the intensity of light emitted therefrom on a continuous basis. The amount of heat generated in the light-emitting devices 142 may be proportional to the intensity of the light emitted therefrom, and thus increasing the intensity of the emitted light results in increased heat generation within the light-emitting devices. The increased heat generation may result in damage to the light-emitting devices 142 if it is of great enough intensity or duration. Accordingly, by emitting the light in short, periodic intervals (i.e., "pulsing" the light-emitting device 144) heat is able to sufficiently dissipate from the light-emitting devices and prevent damage from occurring thereto.

The periodic intervals may be spaced-apart in small enough increments so as not to detrimentally affect the operation of the punching bag system 100. For example, the light-emitting devices 142 may be supplied with electrical current at a variety of intervals, such as 5 to 500 times per second. Furthermore, electrical current may be provided to both the light-emitting devices 142 and the light-receiving devices 144 at substantially the same short, periodic intervals, such that both devices are supplied with electrical current at substantially the same points in time. However, in embodiments that receive electrical current by an electrical outlet or other supply source, either or both of the light-emitting devices 142 and the light-receiving devices 144 may be continuously supplied with electrical current and thus generate light continuously.

In operation, the controller 160 provides electrical current to the light-emitting device 142. The light-emitting devices 142 in turn generate light. When the punching bag 110 is in the down position (as depicted in FIG. 1), the light dissipates and very little, if any, light is reflected into the light-receiving devices 144. The light-receiving devices 144 output a signal of negligible strength. If, however, the punching bag 110 is in the up position (as depicted in FIG. 2), the light is reflected by at least a portion of the neck 114 of the punching bag. The light then travels back in the direction of the light-receiving devices 144 and is received therein. The intensity of the light received in the light-receiving devices 144 is proportional to the proximity of the neck to the light-receiving device. When the neck 114 is in close proximity to the light-receiving device 144, the intensity of the light received therein is of a higher magnitude. Accordingly, when the neck 114 is spaced farther apart from the light-receiving device 144, the intensity of light received therein is of a lower magnitude.

In some embodiments, the color or composition of the material comprising the neck 114 is suitable to reflect the light emitted by the light-emitting devices 142. However, in other embodiments, a reflective component may be positioned around a portion or all of the neck 114 to aid in the reflecting of the light emitted from the light-emitting devices 142 into the light-receiving devices 144. The reflective component may be a reflective piece of tape or other coating, and according to some embodiments, is positioned around a circumferential portion of the punching bag 110. The reflective component or the color or composition of the material may be configured to reflect infrared light.

The signal output by the light-receiving devices 144 is communicated to the controller 160 and analyzed therein. The controller 160 compares the strength of the signal (e.g., voltage) to a predefined first threshold value and a second threshold value. If the strength of the signal is below the first threshold value, the controller 160 determines that the punching bag 110 is in the down position. However, if the strength of the signal is greater than or equal to the second threshold value, the controller 160 determines that the punching bag 100 is in the up position. If the strength of the signal is between the first and second threshold values, the controller 160 determines that the punching bag 110 is not in either the up or down position.

The first threshold value, according to some embodiments, is calculated by placing the punching bag 110 in the down position with the simultaneous emission of light from the light-emitting devices 142 and determining the strength of the signal output by the light-receiving devices 144. The strength of the signal establishes a baseline of signal strength generated by the light-receiving devices 144 in the presence of ambient light in the operating environment surrounding the punching bag system 100. According to some embodiments, the threshold value is defined to be slightly greater (e.g., 5%-10%) than the baseline signal strength.

The second threshold value, according to some embodiments, is calculated by placing the punching bag 110 in the up position and simultaneously emitting light from the light-emitting devices 142 and determining the strength of the signal output by the light-receiving devices 144. The threshold value is then set at a value slightly smaller (e.g., 5%-10%) than the strength of the signal output by the light-receiving devices 144. The threshold values may be calculated when the controller 160 is turned on, or at the direction of the user by pressing the switch 152, or at any other suitable time.

Upon determining that the bag is in the up position or the down position, the controller 160 stores this information in the computer-readable memory. The computer-readably memory may be included within the controller 160, or it may be external to the controller and accessed via any suitable electronic communication mechanism.

According to some embodiments, the controller 160 may periodically analyze the signal output from the light-receiving devices 144, as described above, at a frequency equal to that at which electrical current is provided to the light-emitting devices 142.

Figure 7:
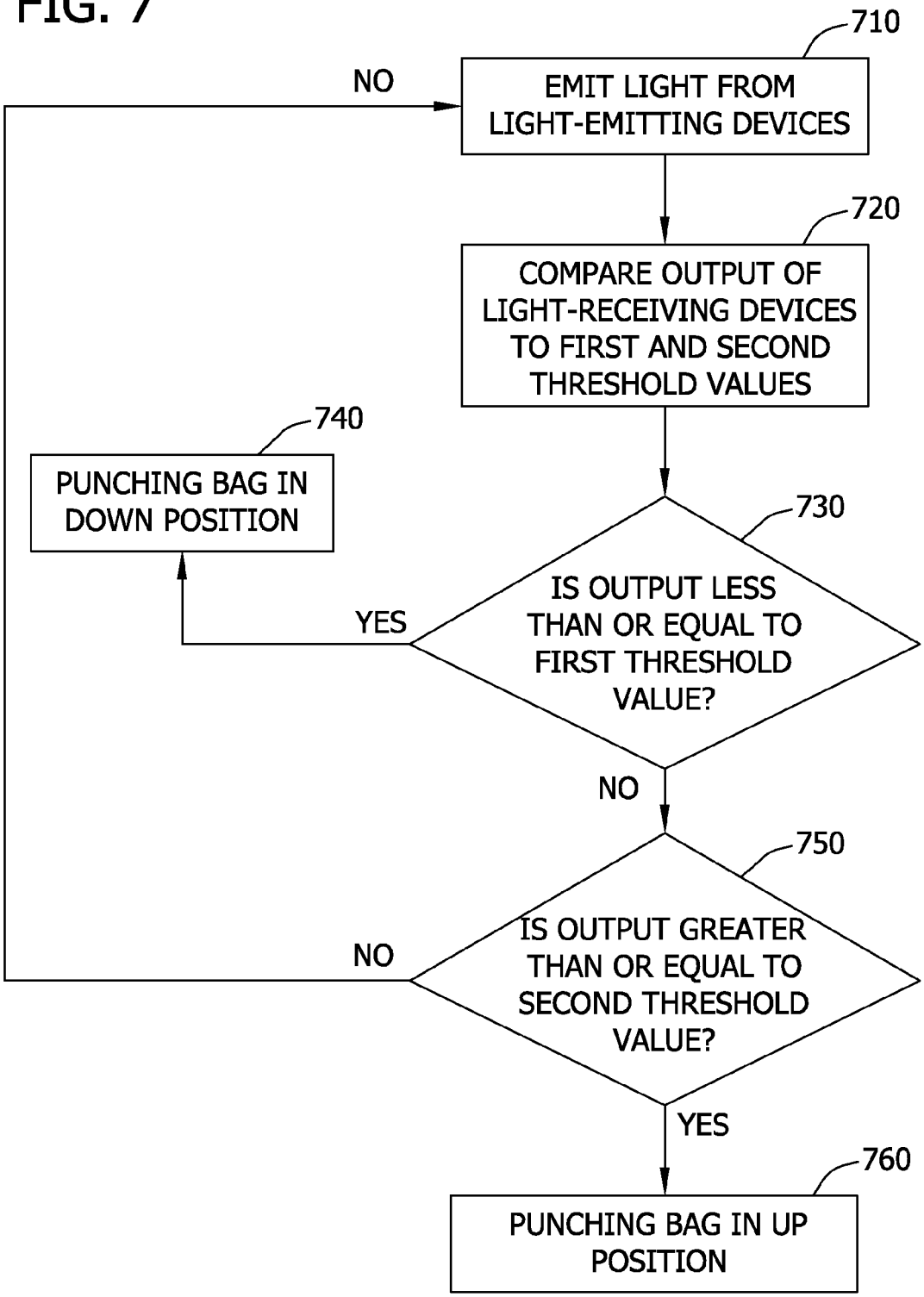
FIG. 7 is a diagram of a process for determining if a punching bag is an up position or a down position.

The process described above is generally depicted in the process diagram of FIG. 7. The process begins with light being emitted from the light-emitting devices in block 710. The signal output by the light-receiving devices is compared to the first threshold value and second threshold value in block 720. In decision block 730, a determination is made of whether the signal output by the light-receiving devices is less than or equal to the first threshold value. If the signal is less than or equal to the first threshold value, the punching bag is in down position and the process proceeds to block 740, otherwise the process proceeds to decision block 750. In decision block 750, a determination is made of whether the signal output by the light-receiving devices is greater than or equal to the second threshold value. If the signal is greater than or equal to the second threshold value, the punching bag is in the up position and the process proceeds to block 760, otherwise the process returns to block 710.

In use, users of the punching bag system 100 are presented with a metric based in part on the determination of whether the punching bag 110 is in the up position or the down position. The metric is presented through the output device 150. A variety of metrics may be implemented, and while specific examples are provided herein, any number of metrics are contemplated according to the scope of the embodiments.

One particular metric is based on the frequency of the punching bag 110 being in either the up position or the down position over a period of time. While there are a variety of methods of punching the punching bag 110, a common method is referred to as a triplet rhythm. Upon being punched by a user, the punching bag 110 travels in the direction of the punch until it comes into contact with the bottom face 132 of the stand 130. The punching bag 110 then rebounds off of the bottom face 132, and reverses direction. The punching bag 110 then travels downward before reversing and traveling up again and coming into contact with the bottom face 132 of the stand 130. The punching bag 110 then once again rebounds off of the bottom face 132 and reverses direction. The user then strikes the punching bag 110 again as it is travelling away from the user. The process then repeats itself.

Figure 8:
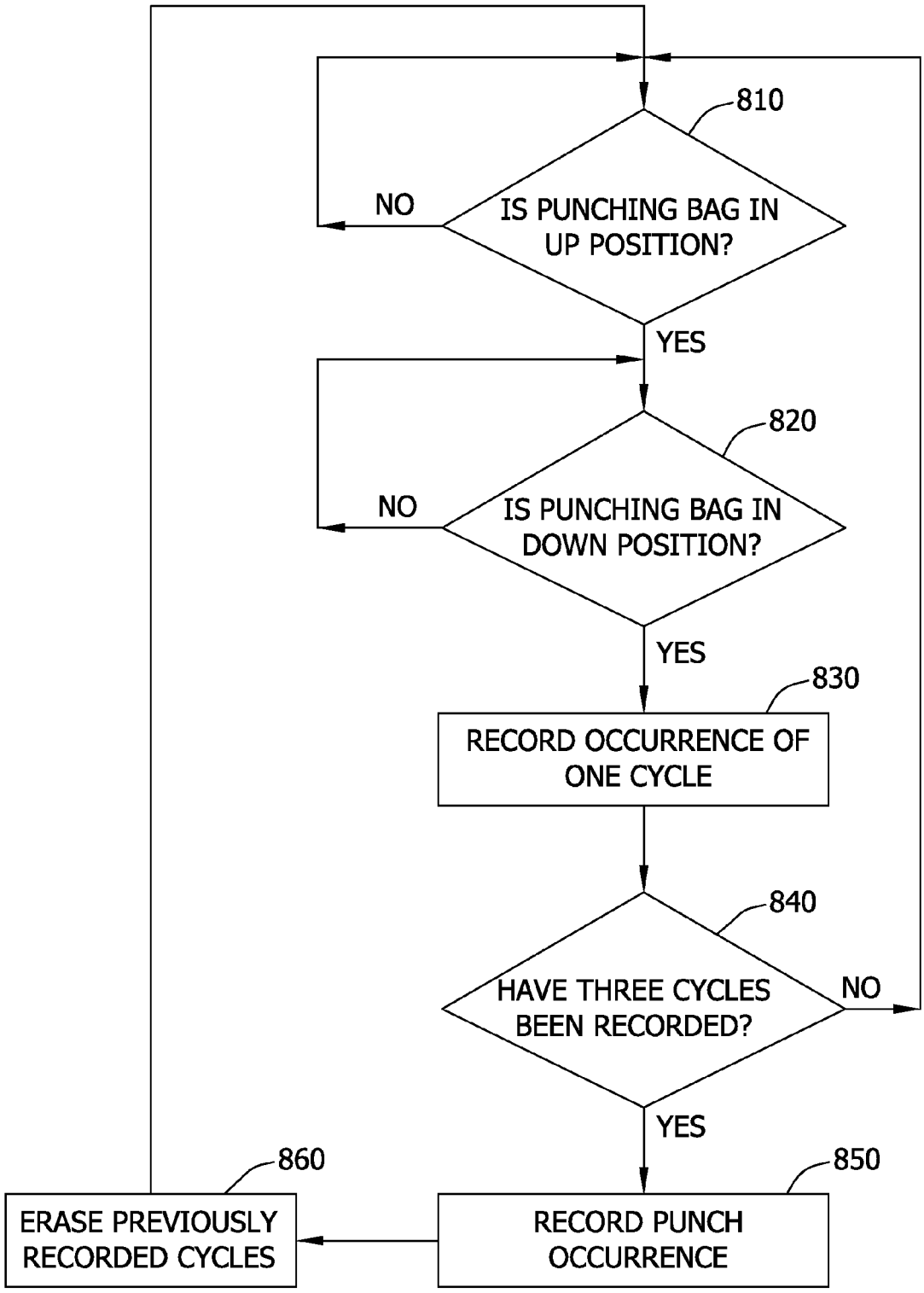
FIG. 8 is a diagram of a process for determining if the punching bag has been punched.

Accordingly, a process as depicted in the diagram of FIG. 8 is utilized in determining the number of times that the user has punched the punching bag. The process begins at block 810 with a determination by the controller of whether the punching bag is in the up position. If the punching bag is not in the up position, the process returns to block 810. If, however, the punching bag is in the up position the process proceeds to block 820. The process proceeds from block 820 only when the punching bag is in the down position, otherwise the process stays at 820 until the controller determines that the punching bag is in the down position.

Upon determining in block 820 that the punching bag is in the down position, the process proceeds to block 830 where an occurrence of one cycle is recorded. The occurrence may be recorded on computer-readable media accessible by the controller. The process then proceeds to block 840 where a determination is made of whether three cycles have been recorded. If three cycles have not been recorded, the process returns to block 810.

If it is determined in block 840 that three cycles have been recorded, the process proceeds to block 850 an occurrence of one punch is recorded. The occurrences of the previously recorded cycles are then erased from the form of computer-readable media in block 860, and the process returns to block 810.

A running total of the number of punches recorded in block 850 is maintained by the controller. The running total of the number of punches may be presented as a metric on the output device 150, according to one embodiment.

In other embodiments, the frequency of the number of punches made over a period of time is presented as a metric. The frequency may be the number of punches per minute, according to an embodiment. The controller 160 may wait until a minute has elapsed, and then present the number of punches recorded during the preceding minute. This average number of punches would be displayed until the next average is determined.

Alternatively, the controller may determine the likely average punches per minute based on the elapsed time being individual punches, and thus continuously update the metric after each punch is recorded. For example, if the controller 160 determines that 1.25 seconds elapsed between punches, a metric of 48 punches per minute would be displayed. This metric is then updated after each punch and presented to the user on the output device 150. The controller 160 may also determine the average number of punches over a period of time and present this information to the user upon request, such as a push by the user of the switch 152.

In other embodiments, a moving average may be updated after a set number of punches by the user. The frequency may be calculated by analyzing the amount of time which elapsed between the previous four punches. For example, if two seconds elapsed between the four most recent punches, the frequency is 120 punches per minute. The average may then be updated after each successive punch, such that only the four most recent punches are utilized in calculating the punch frequency. Other intervals may be used as well, such as every 2, 5, 10, or 15 punches. By utilizing a moving average, the frequency presented to the user more accurately reflects the user's punch frequency as it takes into account a set number of previous punches and updates at frequent intervals that are not dependent on an amount of time having passed. Instead, the intervals at which the frequency is calculated are dependent on the number of punches registered by the controller. The moving average thus serves to "smooth" the punch frequency presented to the user.

According to another embodiment, a reaction time metric may be presented to the user through the output device 150. The controller 160 first presents an indication to the user through the output device 150 to the user. The indication instructs the user to punch the bag. The controller determines the amount of time that elapsed between the presentation of the indicator and a determination of the punching bag 110 being in the up position. The elapsed time is then presented to the user through the output device 150.

In another embodiment, the velocity of the punching bag 110 may be presented to the user as a metric. The velocity of the bag may be calculated by comparing the amount of time which passes between a determination of the punching bag 110 being in the down position and a subsequent determination of the punching bag being in the up position. As the distance from the neck 114 to the light-receiving devices 144 is known and relatively constant between different types of punching bags 110, the distance of a semi-circular arc connecting the two is readily determinable. The average velocity is then determined by dividing the distance by the time that elapsed between the punching bag 110 being in the down position and the up position. The units of the average velocity presented to the user a metric may be manipulated such that output device with its limited display capabilities is able to present the average velocity in a meaningful manner.

EXAMPLE

Figure 9:
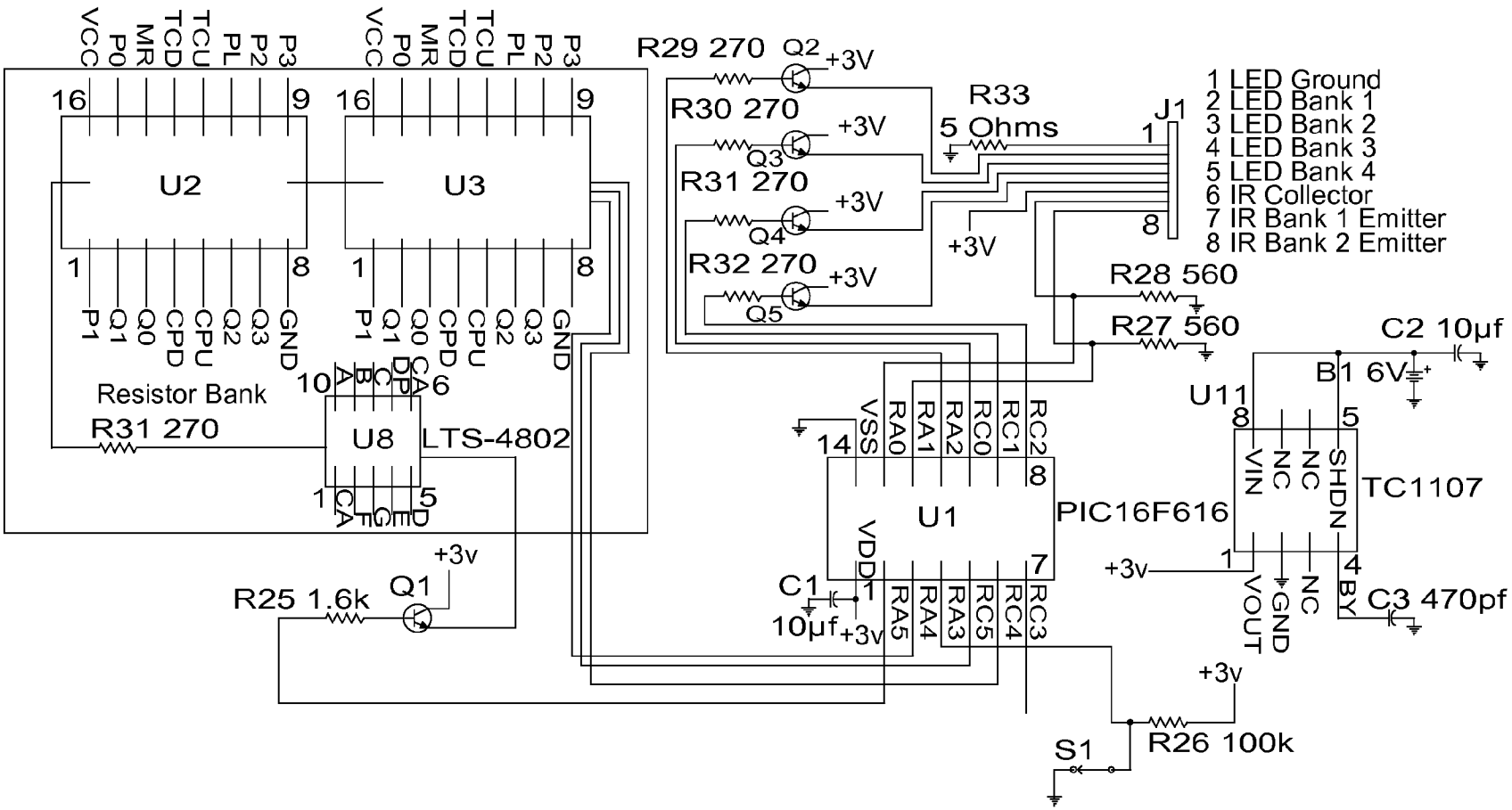
FIG. 9 is a diagram of a circuit used in an exemplary embodiment.

FIG. 9 is a representative schematic depicting the circuits contained on one or more circuit boards within the controller 160. The microcontroller (i.e., the controller 160), in this case a PIC16F616, is powered by a 3V power supply IC (the TC1107), which, in turn, is connected to a 4.5V battery supply. S1 represents the button switch on the device the user can press to change the mode of the device, and it is connected to an input on the microcontroller. The three sets of binary counters coupled with the 7 segment LEDs serve as the display digits in the device. The power to the 7 segment display is controlled by a transistor (Q1) that is controlled by the microcontroller. To display a certain number, the microcontroller toggles a data line on the respective set of binary counters forcing the binary counter to toggle its respective output lines, which, in turn, are connected to the individual segments of the respective 7 segment display. The IR output LED's (i.e., light-emitting devices 142) are connected in four banks and are coupled to the microcontroller through transistors, enabling the microcontroller to rapidly turn the IR output LED's on or off. The two banks of IR detectors or IR phototransistors (i.e., light-receiving devices 144) are connected to the microcontroller through the emitter output lines of the detectors, which are connected in parallel per bank. When IR light strikes the IR phototransistor, the voltage level on the emitter line changes and the analog/digital converter (built into the microcontroller) converts this analog signal to a digital value corresponding to the strength of the analog signal. The two resistors R28 and R27 control the sensitivity of the IR detector circuit.

The microcontroller contains an analog/digital converter that allows it to convert the analog voltage received from the light-receiving devices 144. The analog/digital convertor samples the light-receiving devices 144 at approximately 500 times per second. This sampling rate ensures an accurate reading of the position of the punching bag 110.

The microcontroller operates at a high speed (e.g., 8 MHz or greater) and has external IO pins that are connected to the binary counters and the output pins of the binary counters are connected to the LED display segments to turn them off or on. Thus, by encoding numbers or letters to their seven-segment equivalent, the counters can be used to send letters or numbers to the LED display.

Software may be included within the microcontroller that performs the following functions. Check switch: if the device is off, turn it on; if it has just been turned on, display the current mode and/or change it—also calibrate light-emitting devices 142 to get baseline reading for down position of bag; and if the device is not in selection mode, then turn it off. Update time: keep track of elapsed time for measurement purposes; and turn the device off if no activity after a predetermined time (e.g., 60 seconds). Get the position of the bag: pulse the light-emitting devices 142 to get a value of the signal output by the light-receiving devices 144; and convert the value in an up position or a down position. Track the movement and frequency of the bag: keep a counter of how many times the bag changed from the up to the down position or vice versa; compare this to the elapsed time to determine frequency; divide if necessary by fixed number of rebounds (e.g., 3) to determine number of punches or punch frequency. Update display: update the display to output the punch count, punch frequency, beat count, beat frequency, reaction start, or reaction time, based on the mode the user has selected; and turn off the display in sleep mode. Sleep mode: power down the device; turn off the LEDs and put the microcontroller into sleep mode to conserve power; and occasionally wake up to check the status of the on/off switch.

When introducing elements of the present invention or the embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description and shown in the accompanying drawing[s] shall be interpreted as illustrative and not in a limiting sense.

What is claimed is:

1. A punching bag system comprising:

a punching bag having first and second ends and a longitudinal axis, the punching bag having a neck near its second end;

a stand having a bottom face including a ring-shaped contact area;

a coupling attached to the bottom face and to the second end of the punching bag, wherein the coupling permits the punching bag to travel between an up position in which a portion of the punching bag is disposed near or in contact with the contact area on the bottom face of the stand and a down position where the portion of the punching bag near or on the generally round body is substantially spaced apart from the bottom face of the stand;

light-emitting devices radially positioned on the bottom face of the stand and configured to emit light, wherein the light-emitting devices are radially spaced from the coupling and are spaced from the contact area;

light-receiving devices radially positioned on the bottom face of the stand and configured to generate a signal upon receiving light, wherein the light-receiving devices are radially spaced from the coupling and are spaced from the contact area, and wherein light emitted by the light-emitting devices is reflected into the light-receiving devices by a portion of the neck of the punching bag that is not in contact with the stand when the punching bag is in the up position; and a controller configured to measure the signals from the light-receiving devices and determine when the punching bag is in the up position or the down position based on the signals, wherein after determining a cycle of three successive determinations of the punching bag being in the up position and then in the down position, the controller determines that the punching bag has been punched, and wherein the controller outputs a metric based at least in part on the number of instances that the punching bag has been punched over a period of time.

2. The system of claim 1, wherein the metric is the number of punches of the bag.

3. The system of claim 1, wherein the metric is the number of instances which the bag has been punched over a period of time.

4. The system of claim 3, wherein the metric is the number of instances which the bag has been punched over a period of one minute.

5. The system of claim 1, wherein the metric is the number of cycles of the bag being in the up position and then the down position.

6. The system of claim 1, further comprising an output device for presenting the metric.

7. The system of claim 6, wherein the output device comprises a visual display for presenting the metric to a user.

8. The system of claim 6, wherein the output device comprises an audio output device for presenting the metric to a user.

9. The system of claim 6, wherein the output device is configured to present a user with a notification and the controller is configured to determine the amount of time between the notification being presented to the user and a determination that the bag is in the up position.

10. The system of claim 9, wherein the output device is configured to present the amount of time determined by the controller in claim 9.

11. The system of claim 6, wherein the output device comprises an electronic communication interface configured to present the metric to a computing system.

12. A punching bag system comprising:

a punching bag having a diameter that varies about a longitudinal axis of the punching bag, wherein the punching bag comprises:

a generally round body having a first diameter, wherein the first diameter is the largest diameter of the punching bag;

a neck longitudinally spaced apart from the generally round body and having a second diameter less than the first diameter;

wherein the bag has a first longitudinal end at an end of the longitudinal axis nearest the generally round body and a second longitudinal end at an end of the longitudinal axis nearest the neck; and wherein the first diameter is longitudinally spaced apart from the second longitudinal end by a first distance;

a stand having at least a bottom face, wherein a coupling is attached to the bottom face and connects at least a portion of the second longitudinal end of the punching bag to the bottom face of the stand, and wherein the coupling permits the punching bag to travel between an up position where a portion of the punching bag near or on the generally round body is in contact with the bottom face of the stand and a down position where the portion of the punching bag near or on the generally round body is substantially spaced apart from the bottom face of the stand;

light-emitting devices radially positioned on the bottom face of the stand and configured to emit light, wherein the light-emitting devices are radially spaced from the coupling device at a second distance, wherein the second distance is less than the first distance;

light-receiving devices radially positioned on the bottom face of the stand and configured to generate an output upon receiving light, wherein the light-receiving device are radially spaced from the coupling device at the second distance, and wherein light emitted by the light-emitting devices is reflected into the light-receiving devices by a portion of the neck of the punching bag that is not in contact with the stand when the punching bag is in the up position;

a controller for measuring the output from the light-receiving devices and determining when the punching bag is in the up position or the down position based on the output, and wherein the controller determines a metric based at least in part on the determination of whether the punching bag is in the up position or the down position; and an output device for presenting the metric.

13. The system of claim 12, wherein the metric is the number of instances which the bag has been punched.

14. The system of claim 12, wherein the metric is the number of instances which the bag has been punched over a period of time.

15. The system of claim 12, wherein the light-emitting devices are infrared light emitting diodes (LEDs).

16. The system of claim 12, wherein the light-receiving devices are configured to generate an output upon receiving infrared light.

17. The system of claim 15, wherein the neck of the punching bag is comprised of a material configured to reflect infrared light.

18. The system of claim 12, further comprising a reflective component circumferentially positioned around at least a portion of the neck of the punching bag.

19. The system of claim 18, wherein the reflective component is configured to reflect infrared light.

20. The system of claim 12, wherein the output device comprises a visual display for presenting the metric to a user.

21. An apparatus for determining the location of a punching bag and presenting a metric based at least in part on the determined location of the punching bag, the apparatus comprising:

a circular housing having an inner diameter and an outer diameter, wherein the circular housing is configured to be attached to a stand and the inner diameter and outer diameter are sized to permit a punching bag to be suspended from a coupling attached to the stand and positioned inside the inner diameter of the circular housing, and wherein the outer diameter of the circular housing is sized to prevent contact between the punching bag and the housing when a portion of the punching bag is in contact with the stand while the punching bag is in an up position;

light-emitting devices radially positioned within the circular housing and configured to emit light;

light-receiving devices radially positioned within the circular housing and configured to receive light emitted by the light-emitting devices, wherein at least some of the light emitted from the light-emitting devices is reflected into the light receiving devices by a portion of a neck of the punching bag that is not in contact with the stand when the punching bag is in the up position;

a controller for measuring the output from the light-receiving devices and determining whether the punching bag is in the up position or a down position wherein the punching bag is substantially spaced apart from the stand, and wherein the controller determines a metric based at least in part on the determination of whether the punching bag is in the up position or the down position; and an output device for presenting the metric.

22. The apparatus of claim 21, wherein the outer diameter of the circular housing defines a circumferential portion of the circular housing along which the output device is positioned.

23. The apparatus of claim 22, wherein the output device comprises a visual display.

24. The apparatus of claim 21, wherein the light-emitting devices and light-receiving devices are arranged in pairs of one light-emitting device and one light-receiving device.

25. The apparatus of claim 21, wherein the light-emitting devices are infrared light emitting diodes (LEDs) and the light-receiving devices are configured to generate an output upon receiving infrared light.

26. The apparatus of claim 25, wherein the light-receiving devices are configured to generate an output proportional to the intensity of infrared light received in the light-receiving device.

27. The apparatus of claim 21, wherein light is emitted from the light-emitting devices intermittently according to a defined frequency.

* * * * *